US010246288B2

(12) United States Patent
Minato et al.

(10) Patent No.: US 10,246,288 B2
(45) Date of Patent: Apr. 2, 2019

(54) MEDIUM WINDING DEVICE

(71) Applicant: Oki Data Corporation, Tokyo (JP)

(72) Inventors: Masanori Minato, Tokyo (JP); Mihoko Odate, Tokyo (JP)

(73) Assignee: Oki Data Corporation, Tokyo (JP)

( * ) Notice: Subject to any disclaimer, the term of this patent is extended or adjusted under 35 U.S.C. 154(b) by 333 days.

(21) Appl. No.: 15/047,191

(22) Filed: Feb. 18, 2016

(65) Prior Publication Data

US 2016/0311638 A1 Oct. 27, 2016

(30) Foreign Application Priority Data

Apr. 27, 2015 (JP) ..... 2015-090760

(51) Int. Cl.

| | |
|---|---|
| ***B65H 18/26*** | (2006.01) |
| ***B65H 26/04*** | (2006.01) |
| ***B65H 23/188*** | (2006.01) |
| ***B65H 23/195*** | (2006.01) |
| ***B65H 23/198*** | (2006.01) |

(52) U.S. Cl.

CPC ..... *B65H 23/1888* (2013.01); *B65H 18/26* (2013.01); *B65H 23/198* (2013.01); *B65H 23/1955* (2013.01); *B65H 26/04* (2013.01); *B65H 2301/41335* (2013.01); *B65H 2403/732* (2013.01); *B65H 2404/531* (2013.01); *B65H 2511/112* (2013.01); *B65H 2513/11* (2013.01); *B65H 2553/40* (2013.01); *B65H 2701/1842* (2013.01); *B65H 2801/03* (2013.01); *B65H 2801/12* (2013.01)

(58) Field of Classification Search

CPC .. B65H 23/1888; B65H 23/198; B65H 18/26; B65H 23/1955; B65H 26/04; B65H 2511/112; B65H 2701/1842; B65H 2801/12

See application file for complete search history.

(56) References Cited

U.S. PATENT DOCUMENTS 2,959,369 A * 11/1960 House ..... G11B 15/20 242/334.6
3,441,825 A * 4/1969 Dinger ..... B65H 23/042 242/413.6
4,807,107 A * 2/1989 Fincher ..... G11B 15/43 242/334.6

(Continued)

FOREIGN PATENT DOCUMENTS

JP 2013-216469 A 10/2013

*Primary Examiner* — William A. Rivera
(74) *Attorney, Agent, or Firm* — Rabin & Berdo, P.C.

(57) ABSTRACT

A medium winding device for winding a medium includes: a rotatable winding member; a driver configured to rotate the winding member to wind the medium around the winding member into a roll; a rotating friction member rotatably disposed upstream of the winding member in a conveying direction in which the medium is conveyed, the rotating friction member having a high friction member forming an outer surface of the rotating friction member, and being configured to apply tension to the medium when the medium is wound around the winding member; and a tension adjusting member connected to the rotating friction member and configured to maintain the tension applied to the medium constant.

19 Claims, 9 Drawing Sheets

(56) References Cited

U.S. PATENT DOCUMENTS

| | | | | |
|---|---|---|---|---|
| 5,178,341 | A * | 1/1993 | Ditto | B65H 23/1806 242/412.2 |
| 5,825,374 | A * | 10/1998 | Albertalli | B41J 11/0085 346/136 |
| 8,152,089 | B2 * | 4/2012 | Shin | B65H 23/1955 242/412.2 |
| 2011/0006148 | A1 * | 1/2011 | Tolrud | B65H 18/12 242/413.1 |
| 2012/0050438 | A1 | 3/2012 | Wada | |
| 2013/0119182 | A1 * | 5/2013 | Higeta | B65H 18/145 242/538.1 |
| 2013/0277482 | A1 * | 10/2013 | Naramatsu | B65H 23/063 242/334 |
| 2017/0087903 | A1 * | 3/2017 | Yamabe | B41J 2/01 |
| 2017/0275119 | A1 * | 9/2017 | Hamano | B41J 2/01 |

* cited by examiner

MEDIUM WINDING DEVICE

BACKGROUND OF THE INVENTION

1. Field of the Invention

The present invention relates to a medium winding device.

2. Description of the Related Art

Printers for printing on continuous paper are known (see, for example, Japanese Patent Application Publication No. 2013-216469). A conventional printer receives continuous paper fed from a paper feeding unit, prints on the continuous paper by a printing unit, and then discharges the continuous paper through an outlet to the outside of the printer. A paper winding device is placed adjacent to the outlet of the printer. The paper winding device winds the continuous paper discharged from the printer around a winding roller in a winding unit and forms a paper roll.

SUMMARY OF THE INVENTION

An aspect of the present invention is intended to provide a medium winding device capable of properly winding a medium.

According to an aspect of the present invention, there is provided a medium winding device for winding a medium including: a rotatable winding member; a driver configured to rotate the winding member to wind the medium around the winding member into a roll; a rotating friction member rotatably disposed upstream of the winding member in a conveying direction in which the medium is conveyed, the rotating friction member having a high friction member forming an outer surface of the rotating friction member, and being configured to apply tension to the medium when the medium is wound around the winding member; and a tension adjusting member connected to the rotating friction member and configured to maintain the tension applied to the medium constant.

DETAILED DESCRIPTION OF THE INVENTION

Embodiments of the present invention will now be described with reference to the attached drawings.

First Embodiment

Figure 1:
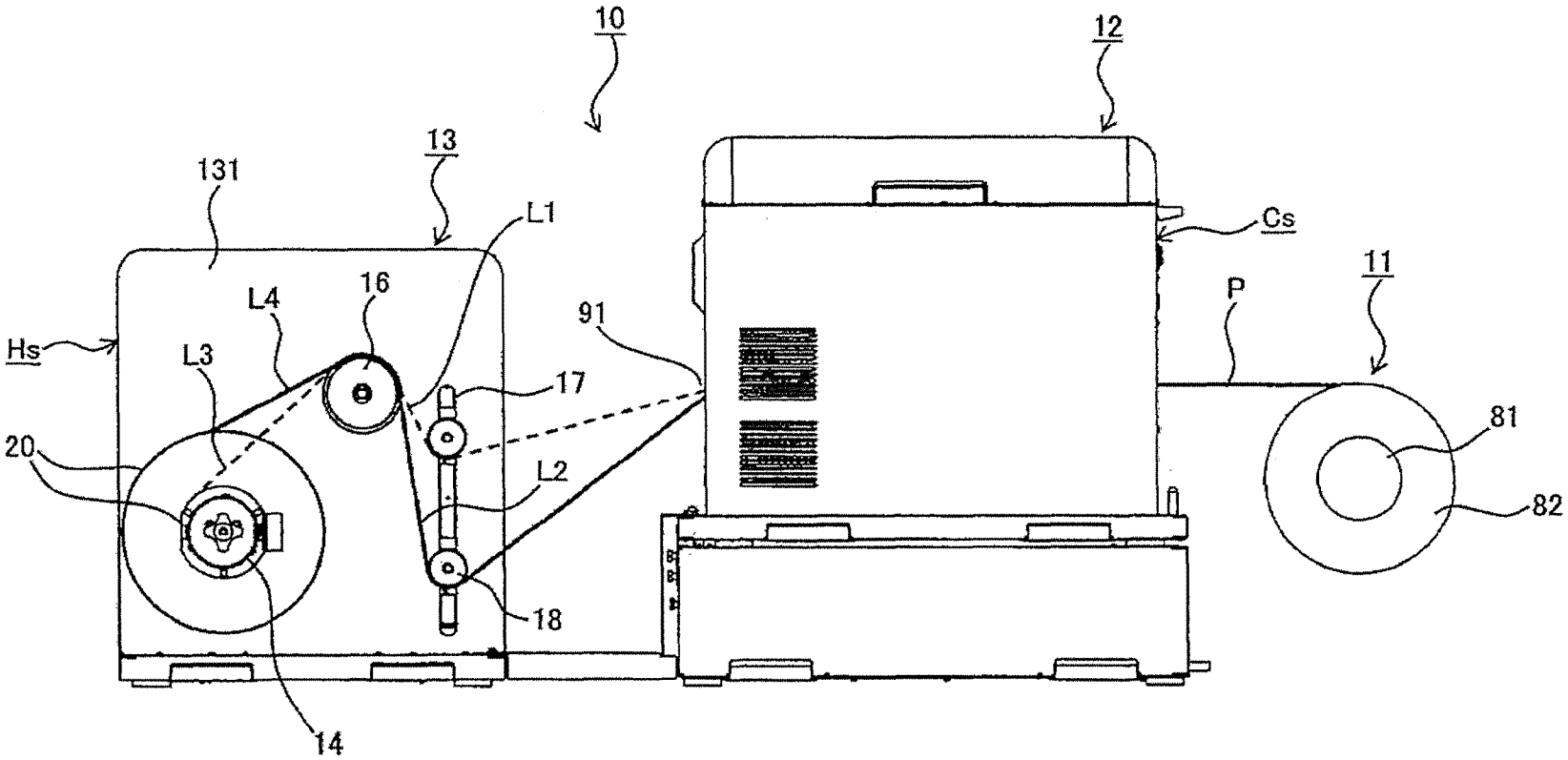
FIG. 1 is an elevation view of a printing system according to a first embodiment of the present invention.

FIG. 1 is an elevation view of a printing system (or print winding unit) 10 according to a first embodiment of the present invention. In FIG. 1, the printing system 10 includes a paper feeding device 11, a printer 12 as an image forming apparatus, and a paper winding device 13 as a medium winding device. The paper feeding device 11 feeds continuous paper (or web) P as along medium. The printer 12 is next to the paper feeding device 11, and prints on the continuous paper P fed from the paper feeding device 11. The paper winding device 13 is next to the printer 12, and winds or takes up the continuous paper P after printing into a roll.

The paper feeding device 11 includes a rotatable paper feed roller 81, on which a paper roll 82 consisting of continuous paper P is mounted. In this embodiment, the continuous paper P may be long high quality paper, film, or label paper.

The printer 12 includes a chassis Cs and a printing unit (or printing engine) in the chassis Cs. The printer 12 prints on the continuous paper P fed from the paper feeding device 11 by the printing unit, and then discharges the continuous paper P through an outlet 91 formed in the chassis Cs to the outside of the printer 12.

Figure 2:
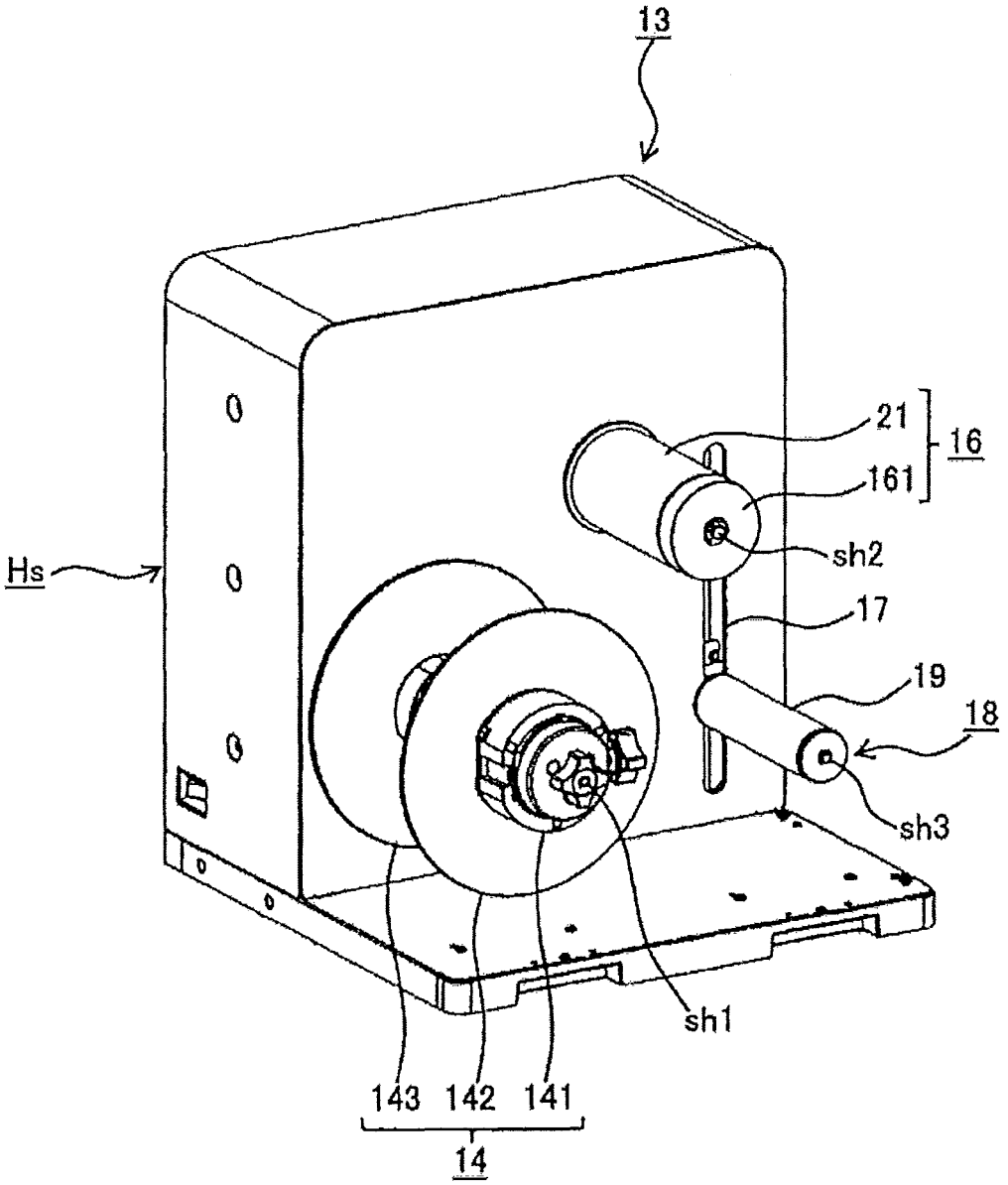
FIG. 2 is a perspective view of a paper winding device according to the first embodiment.
Figure 3:
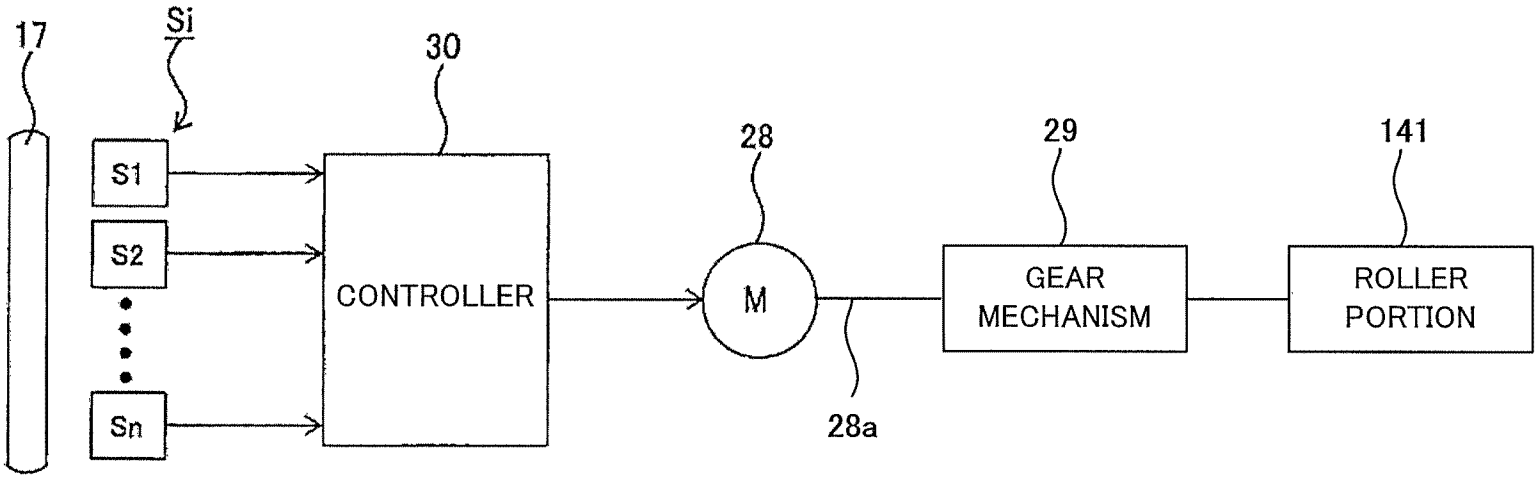
FIG. 3 is a control block diagram of the paper winding device.

FIG. 2 is a perspective view of the paper winding device 13. FIG. 3 is a control block diagram of the paper winding device 13. In FIGS. 1 and 2, the paper winding device 13 includes a housing Hs, a winding roller 14 as a winding member, an idle roller 16 as a first tension applying member and a rotating friction member, a tension bar 18 as a second tension applying member, and the like. In FIG. 3, the paper winding device 13 also includes a winding motor 28 as a driver (or driving unit) for winding, a gear mechanism 29 as a rotation transmission system, multiple bar detection sensors Si (i=1, 2, . . . , n), and a controller 30.

The housing Hs has a front panel 131. The winding roller 14 is rotatably disposed in such a manner as to project from the front panel 131 of the housing Hs. The winding roller 14 is rotated to wind the continuous paper P into a roll. The idle roller 16 is rotatably disposed upstream of the winding roller 14 in a conveying direction in which the continuous paper P is conveyed, and is disposed in such a manner as to project from the front panel 131 of the housing Hs. The idle roller 16 applies tension to the continuous paper P. Specifically, the idle roller 16 is configured to, when the continuous paper P is wound around the winding roller 14, rotate with movement of the continuous paper P due to friction with the continuous paper P and apply tension to the continuous paper P. The tension bar 18 is disposed upstream of the idle roller 16 in the conveying direction of the continuous paper P in such a manner as to project from the front panel 131 of the housing Hs. The tension bar 18 is rotatable and movable in a vertical direction along a slit 17 formed in the housing Hs. The continuous paper P wound around the winding roller 14 forms a paper roll 20 as a medium roll.

The winding roller 14 includes a roller portion 141 and circular plate portions 142 and 143. The roller portion 141 is disposed rotatably about a center shaft sh1, and extends in a width direction of the continuous paper P. In one aspect, the center shaft sh1 is supported by the housing Hs rotatably about its longitudinal axis; the roller portion 141 is fixed to the center shaft sh1 and rotates integrally with the center shaft sh1. In another aspect, the center shaft sh1 is fixed to the housing Hs; the roller portion 141 is mounted on the center shaft sh1 rotatably with respect to the center shaft sh1. The circular plate portions 142 and 143 are formed to project radially outwardly from both end portions of the roller portion 141. The circular plate portions 142 and 143 prevent the continuous paper P from meandering in the width direction when the winding roller 14 is rotated.

The winding motor 28 rotates the winding roller 14 to wind the continuous paper P around the winding roller 14 into a roll. Thus, the winding roller 14 is rotated by driving the winding motor 28. The winding motor 28 has an output shaft 28*a* connected to the roller portion 141 through the gear mechanism 29.

The idle roller 16 includes a roller portion 161 and a high friction member 21. The roller portion 161 extends in the width direction of the continuous paper P and is disposed rotatably about a center shaft sh2. In one aspect, the center shaft sh2 is supported by the housing Hs rotatably about its longitudinal axis; the roller portion 161 is fixed to the center shaft sh2 and rotates integrally with the center shaft sh2. In another aspect, the center shaft sh2 is fixed to the housing Hs; the roller portion 161 is mounted on the center shaft sh2 rotatably with respect to the center shaft sh2. The high friction member 21 forms an outer surface of the idle roller 16. The high friction member 21 is made of a material having a high coefficient of friction, and covers an outer surface of the roller portion 161. The high friction member 21 is made of a material with a high friction coefficient so that when the continuous paper P is conveyed and wound around the winding roller 14, the idle roller 16 rotates due to friction with the continuous paper P at a circumferential speed equal to a conveying speed of the continuous paper P on the idle roller 16, or so that when the continuous paper P is conveyed, the idle roller 16 is rotated by the continuous paper P without slipping with respect to the continuous paper P.

In this embodiment, the high friction member 21 is made of polyurethane rubber, but other rubber materials and materials having high friction coefficients other than rubber may be used.

The tension bar 18 includes a roller portion 19 that extends in the width direction of the continuous paper P and is rotatable about a center shaft sh3. In one aspect, the center shaft sh3 is supported by the housing Hs rotatably about its longitudinal axis; the roller portion 19 is fixed to the center shaft sh3 and rotates integrally with the center shaft sh3. In another aspect, the center shaft sh3 is fixed to the housing Hs; the roller portion 19 is mounted on the center shaft sh3 rotatably with respect to the center shaft sh3. When the continuous paper P is conveyed, the tension bar 18 (or roller portion 19) rotates due to friction with the continuous paper P. The tension bar 18 moves up and down in accordance with rotation and stoppage of the winding roller 14 (or driving and stoppage of the winding motor 28). The tension bar 18 moves up and down along the slit 17. The multiple bar detection sensors Si (i=1, 2, . . . , n) are disposed at predetermined intervals along the slit 17 in the housing Hs. The multiple bar detection sensors Si serve as a sensor for detecting the position of the tension bar 18. The tension bar 18 is urged by a tension structure or urging unit (not illustrated) to apply tension to the continuous paper P.

The bar detection sensors Si output sensor output signals (specifically, on/off signals) as a sensor output to the controller 30. The controller 30 determines the position of the tension bar 18 based on the on/off signals from the bar detection sensors Si, and drives or stops the winding motor 28 in accordance with the position of the tension bar 18. In this embodiment, the paper winding device 13 is configured to wind the continuous paper P around the winding roller 14 by repeatedly alternately rotating and stopping the winding roller 14.

Thus, the winding speed vr [mm/s] at which the continuous paper P is wound when the winding roller 14 is rotated is higher than the discharge speed vd [mm/s] at which the continuous paper P is discharged from the printer 12.

The controller 30 determines whether a condition for driving the winding motor 28 is satisfied, depending on whether the tension bar 18 reaches a predetermined lower limit position in the slit 17, and determines whether a condition for stopping the winding motor 28 is satisfied, depending on whether the tension bar 18 reaches a predetermined upper limit position in the slit 17.

If the tension bar 18 reaches the upper limit position and the bar detection sensor S1 detects the tension bar 18 in the slit 17 to transmit its sensor output signal to the controller 30, the controller 30 determines that the condition for stopping the winding motor 28 is satisfied and stops the winding motor 28.

Thereby, the winding speed vr [mm/s] of the continuous paper P becomes zero, but the discharge speed vd [mm/s] of the continuous paper P does not change. Thus, the tension bar 18 moves down by its own weight along the slit 17 at a speed Vdown proportional to the speed difference δv [mm/s] between the winding speed vr [mm/s] and the discharge speed vd [mm/s]. The speed difference δv [mm/s] is represented by the following equation:

$$\begin{aligned}\delta v\ [\mathrm{mm/s}] &= vr[\mathrm{mm/s}] - vd[\mathrm{mm/s}]\\ &= -vd[\mathrm{mm/s}].\end{aligned}$$

If the tension bar 18 reaches the lower limit position and the bar detection sensor Sn detects the tension bar 18 to transmit its sensor output signal to the controller 30, the controller 30 determines that the condition for driving the winding motor 28 is satisfied and drives the winding motor 28. Thereby, the tension bar 18 moves up along the slit 17 at a speed Vup proportional to the speed difference δv [mm/s].

In FIG. 1, the dashed line L1 indicates the continuous paper P between the tension bar 18 and the idle roller 16 when the tension bar 18 is at the upper limit position. The solid line L2 indicates the continuous paper P between the tension bar 18 and the idle roller 16 when the tension bar 18 is at the lower limit position. The inclination of the continuous paper P indicated by the line L2 with respect to a horizontal plane is greater than that of the continuous paper P indicated by the line L1.

The dashed line L3 indicates the continuous paper P between the paper roll 20 and the idle roller 16 when the continuous paper P begins to be wound around the winding roller 14 and the paper roll 20 has a small diameter. The solid line L4 indicates the continuous paper P between the paper roll 20 and the idle roller 16 when the winding of the continuous paper P around the winding roller 14 has finished and the paper roll 20 has a large diameter. The inclination of the continuous paper P indicated by the line L3 with respect to a horizontal plane is greater than that of the continuous paper P indicated by the line L4.

The area in which the continuous paper P makes contact with the idle roller 16 is minimum when the continuous paper P is indicated by the lines L1 and L4 and maximum when the continuous paper P is indicated by the lines L2 and L3, and always varies. As a result, the tension applied to the continuous paper P varies, and thus the winding hardness of the paper roll 20 varies.

Thus, in this embodiment, the paper winding device 13 is configured to maintain the tension applied to the continuous paper P constant. Specifically, the paper winding device 13 includes a tension adjusting member connected to the idle roller 16 and configured to maintain the tension applied to the continuous paper P constant. In one aspect, the paper winding device 13 is configured to apply a constant load to the idle roller 16 when the idle roller 16 rotates with conveyance of the continuous paper P to maintain the tension applied to the continuous paper P constant. Specifically, the tension adjusting member is configured to maintain the tension applied to the continuous paper P constant by applying a constant load to the idle roller 16, as described below.

Figure 4:
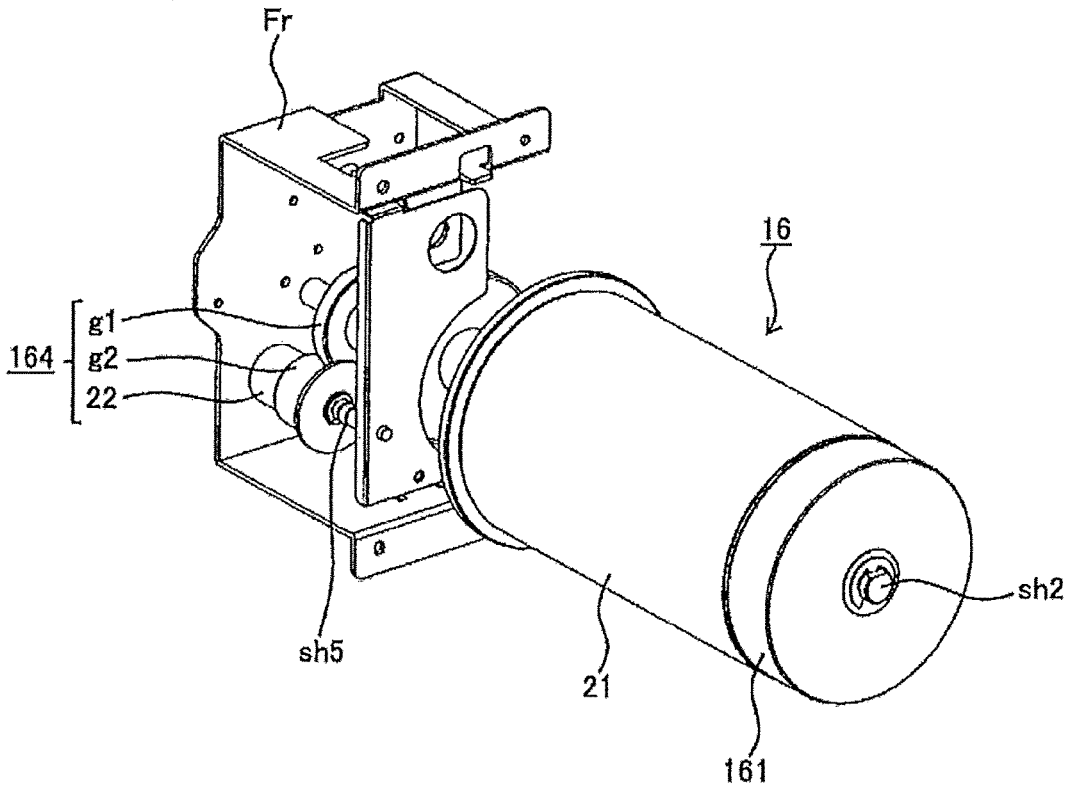
FIG. 4 is a perspective view of a mechanism for applying a load to an idle roller in the first embodiment.

FIG. 4 is a perspective view of a mechanism for applying a load to the idle roller 16. In FIG. 4, the mechanism includes a frame Fr disposed in the housing Hs and mounted to the front panel 131 of the housing Hs, and a tension adjusting device 164 disposed in the frame Fr and connected to the idle roller 16. The tension adjusting device 164 includes a gear g1, a gear g2, and a torque limiter 22 as the tension adjusting member. The gear g1 is disposed on the center shaft sh2 and mounted to a rear end of the roller portion 161. The gear g1 rotates integrally with the roller portion 161. The gear g2 is disposed on a center shaft sh5 extending parallel to the center shaft sh2 and meshes with the gear g1. The gear g2 rotates about the center shaft sh5 while meshing with the gear g1. In one aspect, the center shaft sh5 is fixed to the frame Fr; the gear g2 is mounted rotatably with respect to the center shaft sh5. In another aspect, the center shaft sh5 is supported by the frame Fr rotatably about its longitudinal axis; the gear g2 is fixed to the center shaft sh5 and rotates integrally with the center shaft sh5. The torque limiter 22 serves as a load applying member (or torque applying member) and is configured to, when the idle roller 16 rotates, apply a constant load or torque to the idle roller 16 in a direction opposite to the direction in which the idle roller 16 rotates. The torque limiter 22 is disposed on the center shaft sh5 and mounted to the gear g2. For example, the torque limiter 22 includes a first member fixed to the frame Fr and a second member connected to the gear g2 so as to rotate integrally with the gear g2. The torque limiter 22 is configured to, when the second member rotates relative to the first member, apply a constant torque to the second member in a direction opposite to the rotational direction of the second member. In this embodiment, the torque limiter 22 is a magnet type torque limiter using a permanent magnet, and a load of 400 [gf] is applied by the magnetic force of the permanent magnet to the idle roller 16 on a surface of the idle roller 16.

Thus, regardless of the position of the tension bar 18 in the slit 17 and the diameter of the paper roll 20, a constant tension is applied to the continuous paper P, resulting in uniform winding hardness of the paper roll 20.

Further, when rotation of the winding roller 14 is stopped, for example, it is possible to prevent the idle roller 16 from rotating at a rotational speed higher than the rotational speed of the winding roller 14.

The gears g1 and g2 constitute a rotation transmission system. Although in this embodiment the torque limiter 22 is disposed on the center shaft sh5, the torque limiter 22 may be disposed on the center shaft sh2.

In this embodiment, label paper may be used as the continuous paper P, and to prevent a label from peeling off the paper roll 20 when the paper roll 20 is left as it is for a long period of time, the idle roller 16 has an outer diameter of 3 [inch] (≈76.2 [mm]).

As above, in this embodiment, the idle roller (rotating friction member) 16 is disposed upstream of the winding roller (winding member) 14 in the conveying direction of the continuous paper (medium) P, and the torque limiter (tension adjusting member) 22 is connected to the idle roller 16. With this configuration, the tension applied to the continuous paper P can be made constant. Thus, it is possible to make the winding hardness of the paper roll (medium roll) 20 uniform, thereby winding the continuous paper P around the winding roller 14 while stabilizing the continuous paper P.

Figure 5:
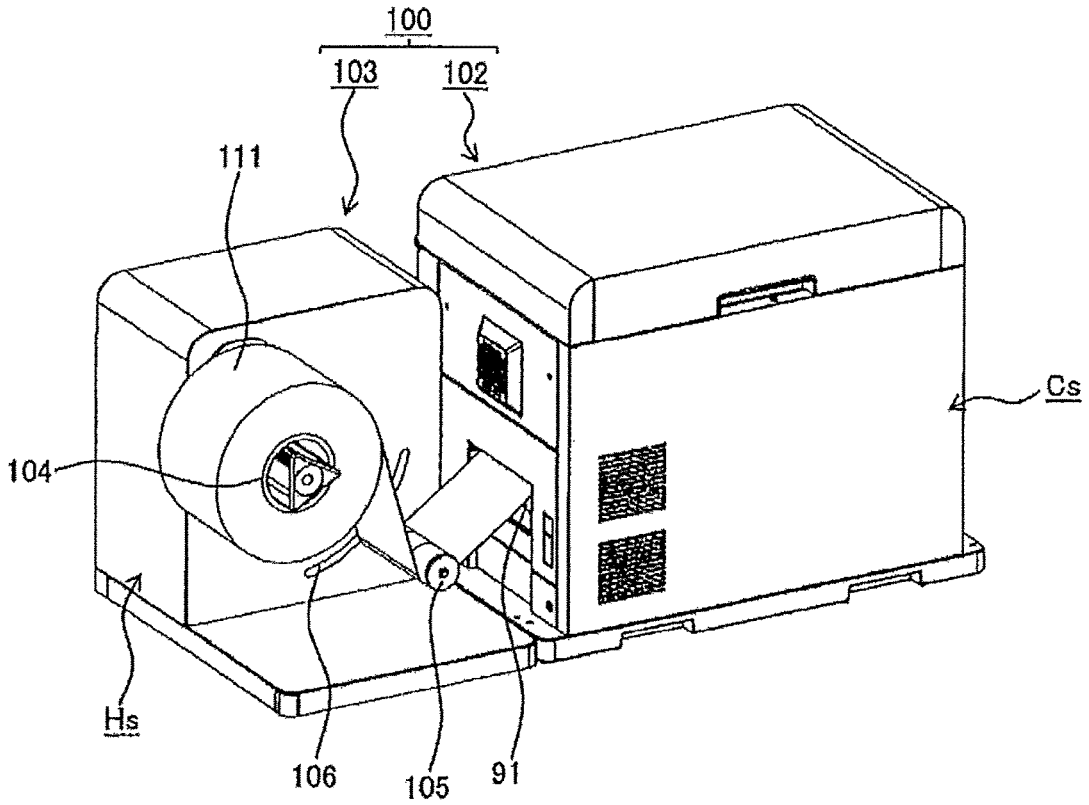
FIG. 5 is a perspective view of a printing system of a comparative example.

FIG. 5 is a perspective view of a printing system (or print winding unit) 100 of a comparative example.

In FIG. 5, the printing system 100 includes a printer 102 and a paper winding device 103. The printer 102 receives continuous paper P fed from a paper feeding device (not illustrated), prints on the continuous paper P by a printing unit, and then discharges the continuous paper P through an outlet 91 formed in a chassis Cs of the printer 102 to the outside of the printer 102.

Figure 6:
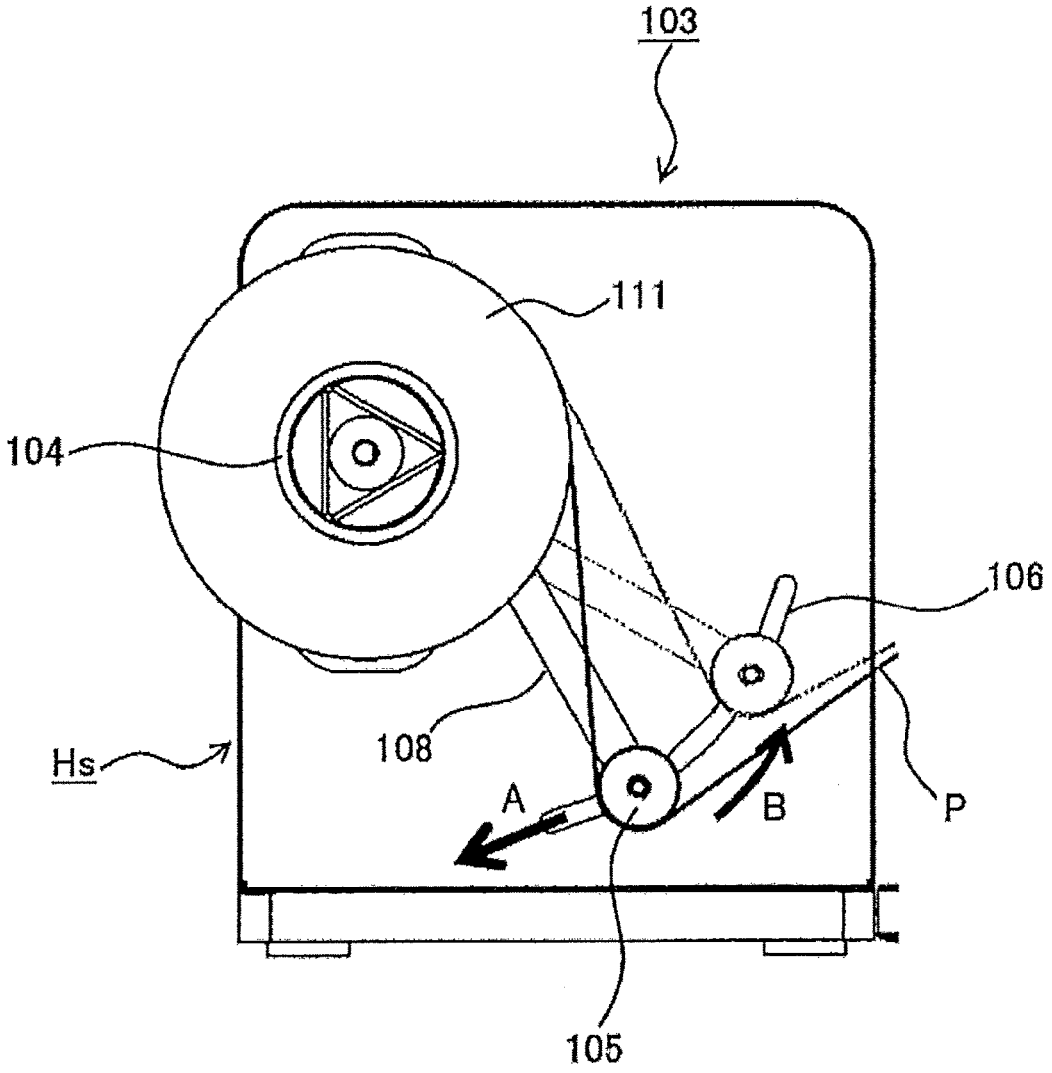
FIG. 6 is an elevation view of the paper winding device of the comparative example.

FIG. 6 is an elevation view of the paper winding device 103. The paper winding device 103 includes a housing Hs, a winding roller 104, a tension bar 105, and the like. The winding roller 104 is rotatably disposed in such a manner as to project from the housing Hs. The winding roller 104 winds the continuous paper P discharged from the printer 102 into a roll thereon. The tension bar 105 is disposed upstream of the winding roller 104 in a conveying direction of the continuous paper P in such a manner as to project from the housing Hs and be swingable in the directions indicated by arrows A and B in FIG. 6 along a slit 106 formed in the housing Hs. The continuous paper P wound around the winding roller 104 forms a paper roll 111.

The tension bar 105 is urged in the direction of arrow A by a tension structure and applies tension to the continuous paper P.

The paper winding device 103 includes, in the housing Hs, a winding motor (not illustrated) for rotating the winding roller 104, a reduction gear (not illustrated) for reducing rotation of the winding motor and transmitting the reduced rotation to the winding roller 104, an arm 108 swingably supporting the tension bar 105, a sensor (not illustrated) for detecting the position of the tension bar 105, and the like.

When the winding motor is driven to rotate the winding roller 104, the continuous paper P is wound around the winding roller 104 at a winding speed higher than the discharge speed at which the continuous paper P is discharged from the printer 102. Accordingly, the tension bar 105 swings along the slit 106 in the direction of arrow B. If the tension bar 105 reaches a predetermined upper limit position, the winding motor is stopped and the winding roller 104 is also stopped, so that the winding of the continuous paper around the winding roller 104 stops.

Meanwhile, the continuous paper P continues to be discharged from the printer 102 at the same discharge speed, and thus the tension bar 105 swings along the slit 106 in the direction of arrow A. If the tension bar 105 reaches a predetermined lower limit position, the winding motor is driven to rotate the winding roller 104, so that the winding of the continuous paper P around the winding roller 104 starts.

In this manner, by repeatedly alternately driving and stopping the winding motor, the paper winding device 103 winds the continuous paper P discharged from the printer 102 around the winding roller 104 and forms the paper roll 111.

However, in the paper winding device 103 of the comparative example, the angle formed by an upstream portion and a downstream portion of the continuous paper P with respect to the tension bar 105 in the conveying direction of the continuous paper P varies with the position of the tension bar 105 between the upper limit position and the lower limit position, and thus tension applied to the continuous paper P varies. As a result, the winding hardness of the paper roll 111 varies, so that it is not possible to wind the continuous paper P while stabilizing the continuous paper P.

The present embodiment can solve the above problem in the paper winding device 103, and provide a medium winding device capable of homogenizing winding hardness of a medium roll and winding a medium while stabilizing the medium.

By the way, after the continuous paper P begins to be wound around the winding roller 14, the diameter of the paper roll 20 increases with time. As the diameter of the paper roll 20 increases, the winding speed vr [mm/s] increases and thus the speed Vup at which the tension bar 18 moves up increases. As a result, the tension applied to the continuous paper P may become too large. This may cause not only non-uniform winding hardness of the paper roll 20 but also undesirable elongation or breakage of the continuous paper P.

Second Embodiment

Thus, a paper winding device according to a second embodiment, which will be described below, is configured to prevent the winding speed vr [mm/s] from becoming too high. Otherwise, the configuration of the paper winding device of the second embodiment is substantially the same as that of the paper winding device 13 of the first embodiment. The paper winding device of the second embodiment can achieve the same advantages as those in the first embodiment. Descriptions of parts that are the same as in the first embodiment will be omitted or simplified in the description below, and the same reference characters will be used for elements that are the same as or correspond to those in the first embodiment.

Figure 7:
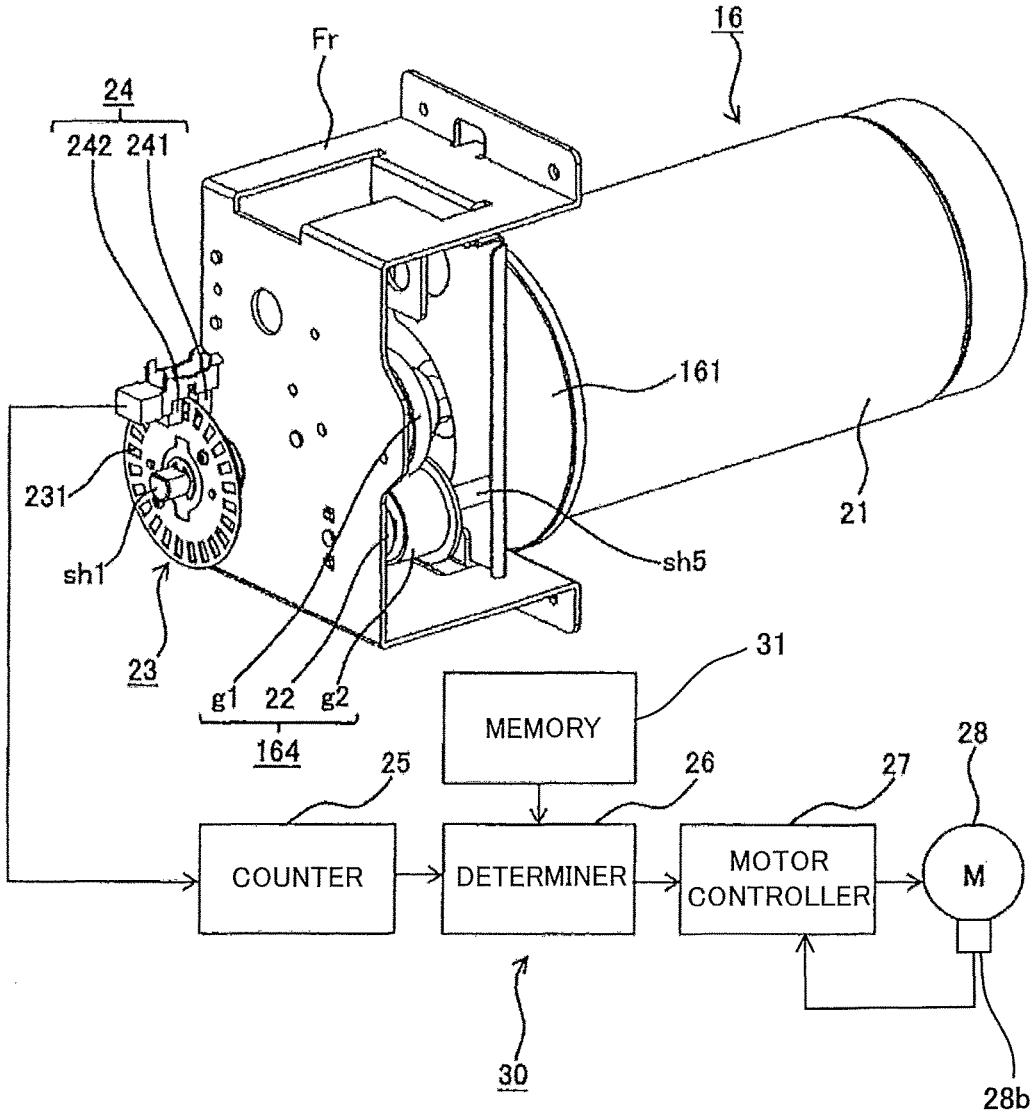
FIG. 7 illustrates a partial configuration of a paper winding device according to a second embodiment of the present invention.

FIG. 7 illustrates a partial configuration of the paper winding device according to the second embodiment. In FIG. 7, the paper winding device includes a slit plate 23 and a transmission type sensor 24 as a detection unit or a speed sensor for detecting a rotational speed of the idle roller 16. The slit plate 23 has a circular shape, and has multiple slits 231 formed at predetermined intervals in an outer peripheral portion of the slit plate 23. The slit plate 23 is mounted on the center shaft sh1 of the idle roller 16. The slit plate 23 rotates integrally with the idle roller 16. The transmission type sensor 24 is disposed to face the outer peripheral portion of the slit plate 23.

The transmission type sensor 24 is a sensor configured to generate a sensor output in accordance with rotation of the idle roller 16. The transmission type sensor 24 includes a light emitter 241 facing one surface of the slit plate 23 and a light receiver 242 facing the other surface of the slit plate 23. The light emitter 241 emits light. The light receiver 242 receives light that is emitted by the light emitter 241 and passes through the slits 231. The transmission type sensor 24 generates a pulse signal as a sensor output (or sensor output signal) corresponding to the light received by the light receiver 242, and transmits the pulse signal to the controller 30. The pulse signal is high (or on) when the light receiver 242 receives light; the pulse signal is low (or off) when the light receiver 242 receives no light. As the slit plate 23 rotates, the transmission type sensor 24 outputs a pulse signal consisting of multiple pulses, each of which corresponds to one of the slits 231. The duration or width of each pulse varies with the rotational speed of the slit plate 23. The interval between successive pulses or pulse period also varies with the rotational speed of the slit plate 23.

As described above, the larger the diameter of the paper roll 20, the higher the winding speed vr [mm/s].

Figure 8:
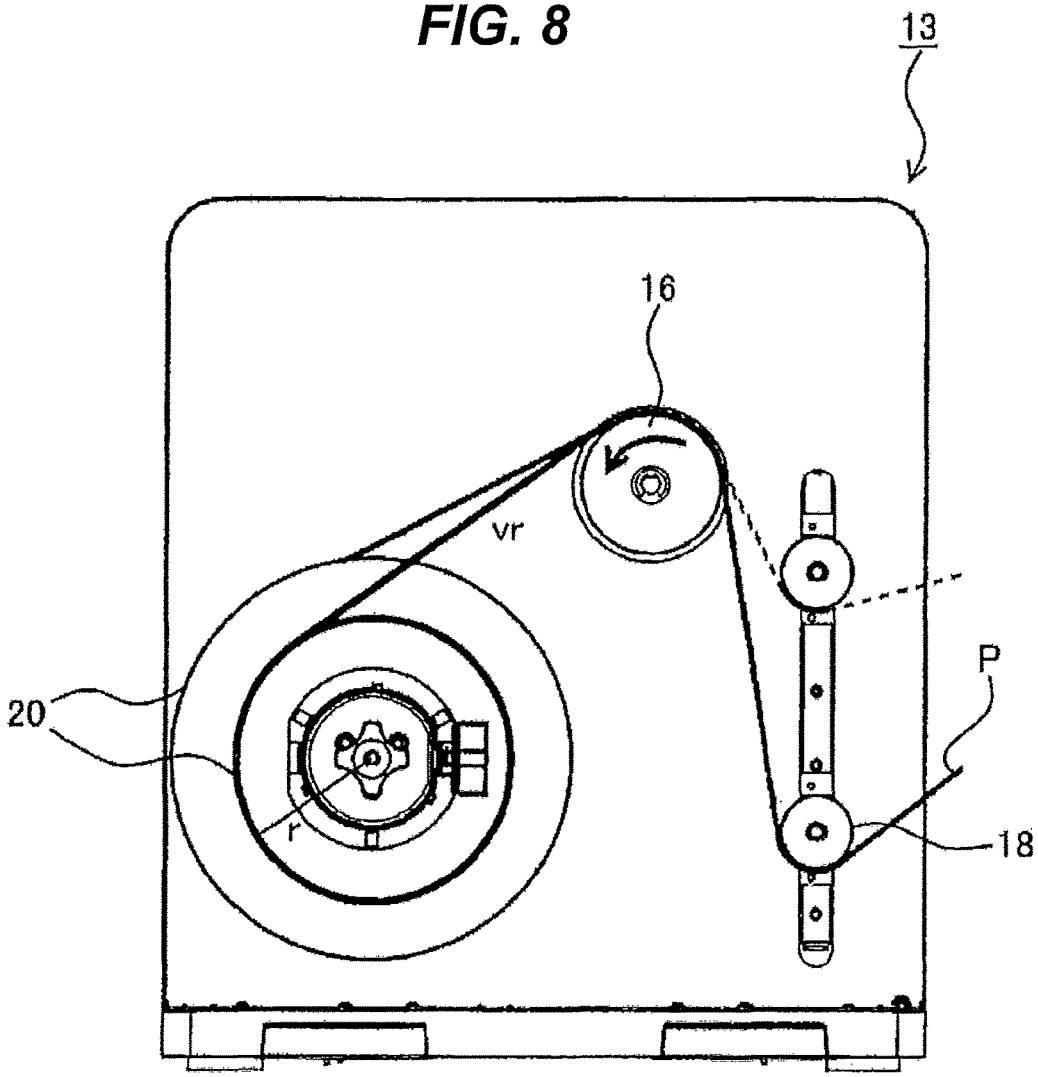
FIG. 8 is a view for explaining the relationship between the diameter of a paper roll and the rotational speed of an idle roller in the second embodiment.

For example, if it is assumed that the winding motor 28 is driven at a rotational speed Nm [rpm] (revolutions per minute), the winding roller 14 is driven by the winding motor 28 at a rotational speed equal to the rotational speed Nm [rpm] of the winding motor 28, and the radius of the paper roll 20 is r [mm] as illustrated in FIG. 8, the winding speed vr [mm/s] is represented by the following equation (1):

$$vr\ [\mathrm{mm/s}]=(Nm\ [\mathrm{rpm}]/60\ [\mathrm{s}])\times(2\times\pi\times r\ [\mathrm{mm}]) \quad (1).$$

Equation (1) shows that the larger the diameter r [mm] of the paper roll 20, the higher the winding speed vr [mm/s].

Figure 9A:
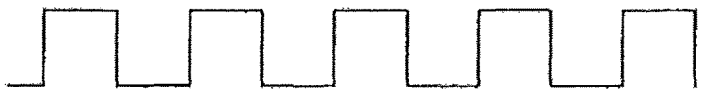
FIG. 9A is a diagram illustrating an example of a pulse signal of a transmission type sensor in the second embodiment.
Figure 9B:
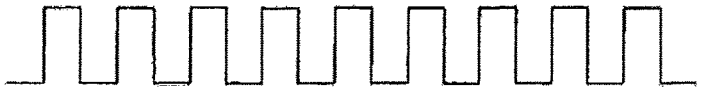
FIG. 9B is a diagram illustrating another example of the pulse signal of the transmission type sensor in the second embodiment.

Thus, when the radius r [mm] of the paper roll 20 is small, the rotational speed Nr [rpm] of the idle roller 16 is low, and the pulse period of the pulse signal of the transmission type sensor 24 is long as illustrated in FIG. 9A. When the radius r [mm] of the paper roll 20 is large, the rotational speed Nr [rpm] of the idle roller 16 is high, and the pulse period of the pulse signal of the transmission type sensor 24 is short as illustrated in FIG. 9B.

The controller 30 receives the pulse signal from the transmission type sensor 24, and drives or controls the winding motor 28 based on the pulse signal so as to prevent the rotational speed Nr [rpm] from becoming too high.

The controller 30 includes a counter 25 as a receiver (or sensor output acquisition unit), a determiner 26, a motor controller 27 as a drive controller, and the like.

The counter 25 receives or acquires the sensor output generated by the transmission type sensor 24. The determiner 26 determines, based on the sensor output received by the counter 25, whether the rotational speed of the idle roller 16 is equal to or greater than a first threshold value. In this embodiment, the determiner 26 determines whether the rotational speed of the idle roller 16 is equal to or greater than the first threshold value, depending on whether a pulse period of the pulse signal is equal to or less than a second threshold value. If it is determined that the rotational speed of the idle roller 16 is equal to or greater than the first threshold value, the motor controller 27 controls the winding motor 28 to decrease the rotational speed of the winding roller 14.

Specifically, the counter 25 receives the pulse signal from the transmission type sensor 24, and obtains a count value C indicating a pulse period. For example, the counter 25 obtains a count value C by counting at regular intervals during a time period during which the pulse signal is high and the subsequent time period during which the pulse signal is low. Thus, the longer the pulse period, the greater the count value C. The determiner 26 compares the count value C obtained by the counter 25 with a predetermined threshold value Cth and determines whether the count value C is equal to or less than the threshold value Cth. If it is determined that the count value C is equal to or less than the threshold value Cth, the motor controller 27 decreases the rotational speed Nm [rpm] of the winding motor 28. In FIG. 7, the controller 30 includes a memory 31 storing the threshold value Cth, and the determiner 26 reads the threshold value Cth from the memory 31.

If it is assumed that the radius of the idle roller 16 is ra [mm], the rotational speed Nr [rpm] of the idle roller 16 is represented by the following equation (2):

$$Nr\ [\text{rpm}]=(vr\ [\text{mm/s}]\times 60)/(2\times\pi\times ra\ [\text{mm}]) \quad (2).$$

The time Tr [s] required for one revolution of the idle roller 16 is represented by the following equation (3):

$$\begin{aligned} Tr[\text{s}] &= (1/Nr[rmp])\times 60 \quad (3)\\ &= (2\times\pi\times ra[\text{mm}])\times 60/(vr[\text{mm/s}]\times 60)\\ &= (2\times\pi\times ra[\text{mm}])/vr[\text{mm/s}]. \end{aligned}$$

If it is assumed that the number of slits 231 of the slit plate 23 is SL, the pulse period Ts [s] is represented by the following equation (4):

$$\begin{aligned} Ts\ [s] &= Tr\ [s]/SL \quad (4)\\ &= ((2\times\pi\times ra[\text{mm}])/vr[\text{mm/s}])/SL. \end{aligned}$$

Thus, if it is assumed that the counter 25 counts at intervals of Tn [s], the count value C is represented by the following equation (5):

$$\begin{aligned} C &= Ts[\text{s}]/Tn[s] \quad (5)\\ &= (((2\times\pi\times ra[\text{mm}])/vr[\text{mm/s}])/SL)/Tn[\text{s}]. \end{aligned}$$

Equation (5) shows that the higher the winding speed vr [mm/s], the less the count value C.

Thus, as described above, the determiner 26 receives the count value C from the counter 25, and compares the count value C with the predetermined threshold value Cth to determine whether the count value C is equal to or less than the threshold value Cth, and if it is determined that the count value C is equal to or less than the threshold value Cth, the motor controller 27 decreases the rotational speed Nm [rpm] of the winding motor 28. The value to which the rotational speed Nm [rpm] is decreased is set so that the winding speed vr [mm/s] is higher than the discharge speed vd [mm/s] and the continuous paper P can be wound around the winding roller 14.

The pulse period of the pulse signal is inversely proportional to the rotational speed of the slit plate 23. Thus, the counter 25 may function as a roller rotational speed obtaining unit and obtain (or calculate) the rotational speed Nr [rpm] of the idle roller 16 based on the inverse of the count value C by the following equation:

$$Nr=a\times 1/C$$

where a is a coefficient.

In this case, the determiner 26 reads the obtained rotational speed Nr [rpm] of the idle roller 16 from the counter 25, reads the inverse of the threshold value Cth as a threshold value Nrth [rpm] for the rotational speed Nr [rpm], and determines whether the rotational speed Nr [rpm] of the idle roller 16 is equal to or greater than the threshold value Nrth [rpm]. If it is determined that the rotational speed Nr [rpm] is equal to or greater than the threshold value Nrth [rpm], the motor controller 27 decreases the rotational speed Nm [rpm] of the winding motor 28.

The operation of the paper winding device 13 in the second embodiment will now be described.

First, while the winding roller 14 is in a stopped state, the printer 12 (FIG. 1) prints on the continuous paper P and discharges the continuous paper P at the discharge speed vd [mm/s], causing the tension bar 18 to move down.

The controller 30 receives sensor output signals from the bar detection sensors Si (FIG. 3), and determines whether the condition for driving the winding motor 28 is satisfied. When the tension bar 18 reaches the lower limit position and the condition for driving the winding motor 28 is satisfied, the motor controller 27 drives (or starts to drive) the winding motor 28 at a predetermined rotational speed Nm [rpm] to rotate the winding roller 14, thereby winding the continuous paper P around the winding roller 14 at a winding speed vr [mm/s]. This causes the tension bar 18 to move up.

Then, the controller 30 receives sensor output signals from the bar detection sensors Si, and determines whether the condition for stopping the winding motor 28 is satisfied. When the tension bar 18 reaches the upper limit position and the condition for stopping the winding motor 28 is satisfied, the motor controller 27 stops the winding motor 28.

If it is determined that the condition for stopping is not satisfied, the controller 30 receives a sensor output signal from a speed sensor 28*b* (FIG. 7) provided to the winding motor 28, and determines whether the rotational speed Nm [rpm] of the winding motor 28 is constant. If it is determined that the rotational speed Nm [rpm] is constant, the counter 25 receives a pulse signal from the transmission type sensor 24, and obtains a count value C indicating the pulse period.

Then, the determiner 26 receives the count value C from the counter 25, compares the count value C with the threshold value Cth to determine whether the count value C is equal to or less than the threshold value Cth. If it is determined that the count value C is equal to or less than the threshold value Cth, the motor controller 27 decreases the rotational speed Nm [rpm] of the winding motor 28.

The threshold value Cth is set so as to prevent non-uniform winding hardness and undesirable elongation or breakage of the continuous paper P.

Figure 10:
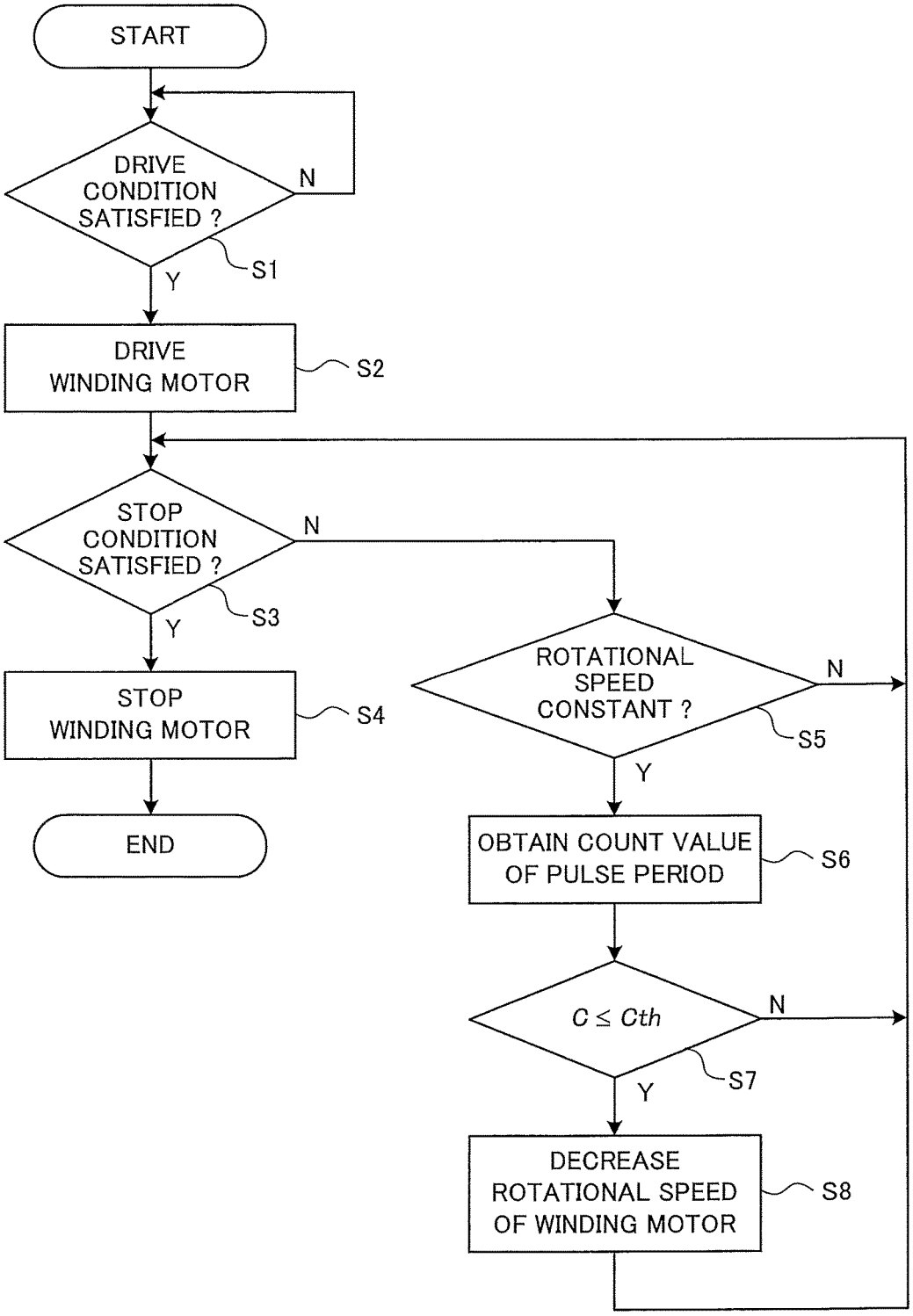
FIG. 10 is a flowchart illustrating an operation of the paper winding device according to the second embodiment.

FIG. 10 is a flowchart illustrating the operation of the paper winding device 13 of the second embodiment. The operation of the paper winding device 13 will be described with reference to FIG. 10.

In step S1, the controller 30 determines whether the condition for driving the winding motor 28 is satisfied. If it is determined that the condition for driving the winding motor 28 is satisfied, the process proceeds to step S2.

In step S2, the motor controller 27 drives the winding motor 28.

In step S3, the controller 30 determines whether the condition for stopping the winding motor 28 is satisfied. If it is determined that the condition for stopping the winding motor 28 is satisfied, the process proceeds to step S4. If it is determined that the condition for stopping the winding motor 28 is not satisfied, the process proceeds to step S5.

In step S4, the motor controller 27 stops the winding motor 28 and ends the process.

In step S5, the controller 30 determines whether the rotational speed Nm [rpm] is constant. If it is determined that the rotational speed Nm [rpm] is constant, the process proceeds to step S6. If it is determined that the rotational speed Nm [rpm] is not constant, the process returns to step S3.

In step S6, the counter 25 obtains a count value C indicating a pulse period.

In step S7, the determiner 26 determines whether the count value C is equal to or less than the threshold value Cth. If it is determined that the count value C is equal to or less than the threshold value Cth, the process proceeds to step S8. If it is determined that the count value C is greater than the threshold value Cth, the process returns to step S3.

In step S8, the motor controller 27 decreases the rotational speed Nm [rpm] of the winding motor 28, and the process returns to step S3.

As above, in this embodiment, if the count value C indicating a pulse period of the pulse signal of the transmission type sensor 24 is equal to or less than the threshold value Cth, the rotational speed Nm [rpm] of the winding motor 28 is decreased. This prevents the winding speed vr [mm/s] from becoming too high and reduces change in the winding speed vr [mm/s], thereby making the winding hardness more uniform and preventing undesirable elongation or breakage of the continuous paper P.

Further, in this embodiment, the rotational speed Nm [rpm] of the winding motor 28 is decreased in accordance with the pulse signal of the transmission type sensor 24. Thus, there is no need to calculate the radius r [mm] of the paper roll 20 based on the amount of the continuous paper P discharged from the printer 12 or the like. This can simplify control in the paper winding device 13. Further, if the paper winding device 13 is not connected to the printer 12 and operates in a stand-alone manner, the paper winding device 13 can decrease the rotational speed Nm [rpm] of the winding motor 28.

In addition, to decrease the rotational speed Nm [rpm] of the winding motor 28, an operator need neither input the thickness of the continuous paper P nor refer to the thickness of the continuous paper P in a memory or the like. This can simplify operation by the operator.

The present invention is not limited to the embodiments described above; it can be practiced in various other aspects without departing from the inventive scope.

What is claimed is:

1. A medium winding device for winding a medium, comprising:

a rotatable winding-member;

a driver configured to rotate the winding member to wind the medium around the winding member into a roll;

a rotating friction member rotatably disposed upstream of the winding member in a conveying direction in which the medium is conveyed, the rotating friction member having a high friction member forming an outer surface of the rotating friction member, and being configured to apply tension to the medium when the medium is wound around the winding member; and a tension adjusting member connected to the rotating friction member and configured to maintain the tension applied to the medium to be constant, by applying a constant load to the rotating friction member.

2. The medium winding device of claim 1, further comprising a tension bar disposed upstream of the rotating friction member in the conveying direction, the tension bar being movable in a vertical direction and configured to move up and down in accordance with rotation and stoppage of the winding member.

3. The medium winding device of claim 2, further comprising:

a sensor configured to generate a sensor output in accordance with rotation of the rotating friction member;

a receiver configured to receive the generated sensor output;

a determiner configured to determine, based on the received sensor output, whether a rotational speed of the rotating friction member is equal to or greater than a first threshold value; and a drive controller configured to, if it is determined that the rotational speed of the rotating friction member is equal to or greater than the first threshold value, control the driver to decrease a rotational speed of the winding member.

4. The medium winding device of claim 3, wherein:

the sensor output of the sensor is a pulse signal; and the determiner determines whether the rotational speed of the rotating friction member is equal to or greater than the first threshold value, depending on whether a pulse period of the pulse signal is equal to or less than a second threshold value.

5. The medium winding device of claim 1, further comprising a tension bar disposed upstream of the rotating friction member in the conveying direction, the tension bar being movable in a vertical direction and configured to move up and down in accordance with rotation and stoppage of the winding member.

6. The medium winding device of claim 1, further comprising a tension member disposed upstream of the rotating friction member in the conveying direction, the tension member being movable in a first direction and a second direction opposite to the first direction, the tension member being urged in the first direction by an urging force to apply tension to the medium.

7. The medium winding device of claim 6, wherein:

the tension member is disposed downstream of a feeding portion from which the medium is fed to the medium winding device;

as a length of the medium between the rotating friction member and the feeding portion decreases, the tension member is pushed by the medium to move in the second direction; and as the length of the medium increases, the tension member moves by the urging force in the first direction while pushing the medium.

8. The medium winding device of claim 7, further comprising a controller configured to control the driver to rotate the winding member if the tension member reaches a first predetermined position and stop the winding member if the tension member reaches a second predetermined position located in the second direction from the first predetermined position.

9. The medium winding device of claim 6, further comprising a controller configured to control the driver to rotate the winding member if the tension member reaches a first predetermined position and stop the winding member if the tension member reaches a second predetermined position located in the second direction from the first predetermined position.

10. The medium winding device of claim 6, further comprising:

a sensor configured to generate a sensor output in accordance with rotation of the rotating friction member;

a receiver configured to receive the generated sensor output;

a determiner configured to determine, based on the received sensor output, whether a rotational speed of the rotating friction member is equal to or greater than a first threshold value; and a drive controller configured to, if it is determined that the rotational speed of the rotating friction member is equal to or greater than the first threshold value, control the driver to decrease a rotational speed of the winding member.

11. The medium winding device of claim 10, wherein:

the sensor output of the sensor is a pulse signal; and the determiner determines whether the rotational speed of the rotating friction member is equal to or greater than the first threshold value, depending on whether a pulse period of the pulse signal is equal to or less than a second threshold value.

12. The medium winding device of claim 1, further comprising:

a sensor configured to generate a sensor output in accordance with rotation of the rotating friction member;

a receiver configured to receive the generated sensor output;

a determiner configured to determine, based on the received sensor output, whether a rotational speed of the rotating friction member is equal to or greater than a first threshold value; and a drive controller configured to, if it is determined that the rotational speed of the rotating friction member is equal to or greater than the first threshold value, control the driver to decrease a rotational speed of the winding member.

13. The medium winding device of claim 12, wherein:

the sensor output of the sensor is a pulse signal; and the determiner determines whether the rotational speed of the rotating friction member is equal to or greater than the first threshold value, depending on whether a pulse period of the pulse signal is equal to or less than a second threshold value.

14. The medium winding device of claim 1, further comprising:

a sensor configured to generate a sensor output in accordance with rotation of the rotating friction member;

a receiver configured to receive the generated sensor output;

a determiner configured to determine, based on the received sensor output, whether a rotational speed of the rotating friction member is equal to or greater than a first threshold value; and a drive controller configured to, if it is determined that the rotational speed of the rotating friction member is equal to or greater than the first threshold value, control the driver to decrease a rotational speed of the winding member.

15. The medium winding device of claim 14, wherein:

the sensor output of the sensor is a pulse signal; and the determiner determines whether the rotational speed of the rotating friction member is equal to or greater than the first threshold value, depending on whether a pulse period of the pulse signal is equal to or less than a second threshold value.

16. The medium winding device of claim 1, wherein the high friction member is made of a material having a high coefficient of friction so that when the medium is conveyed, the rotating friction member is rotated by the medium without slipping with respect to the medium.

17. The medium winding device of claim 1, wherein the tension adjusting member is configured to apply the constant load to the rotating friction member without intervention of the medium.

18. The medium winding device of claim 1, wherein the tension adjusting member is a torque limiter configured to, when the rotating friction member rotates, apply the constant load to the rotating friction member in a direction opposite to a direction in which the rotating friction member rotates.

19. The medium winding device of claim 18, wherein the tension adjusting member includes a first member and a second member connected to the rotating friction member, wherein when the second member rotates relative to the first member, a constant torque is applied to the second member in a direction opposite to a rotational direction of the second member.

* * * * *